US007997416B2

(12) United States Patent
Vecchiato

(10) Patent No.: US 7,997,416 B2
(45) Date of Patent: Aug. 16, 2011

(54) OSCILLATING SCREEN

(76) Inventor: Sergio Vecchiato, Mortegliano (IT)

( * ) Notice: Subject to any disclaimer, the term of this patent is extended or adjusted under 35 U.S.C. 154(b) by 140 days.

(21) Appl. No.: 12/532,445

(22) PCT Filed: Mar. 21, 2008

(86) PCT No.: PCT/EP2008/053442

§ 371 (c)(1),
(2), (4) Date: Sep. 22, 2009

(87) PCT Pub. No.: WO2008/116850

PCT Pub. Date: Oct. 2, 2008

(65) Prior Publication Data

US 2010/0108575 A1 May 6, 2010

(30) Foreign Application Priority Data

Mar. 23, 2007 (IT) ..... UD2007A0061

(51) Int. Cl.
*B07B 1/36* (2006.01)
*B07B 1/38* (2006.01)

(52) U.S. Cl. ..... 209/366.5; 209/331; 209/332; 209/366; 209/367

(58) Field of Classification Search ..... 209/331, 209/332, 364, 365.3, 366, 366.5, 367
See application file for complete search history.

(56) References Cited

U.S. PATENT DOCUMENTS

| | | | | |
|---|---|---|---|---|
| 497,343 | A * | 5/1893 | Rasch | 209/332 |
| 620,048 | A * | 2/1899 | Oyer | 209/332 |
| 3,444,999 | A | 5/1969 | Hurst | |
| 3,756,407 | A * | 9/1973 | Christensen | 209/332 |
| 4,107,035 | A * | 8/1978 | Foresman | 209/309 |
| 4,167,478 | A * | 9/1979 | Salete | 209/331 |

FOREIGN PATENT DOCUMENTS

| | | |
|---|---|---|
| DE | 214 999 | 10/1909 |
| FR | 323 693 | 3/1903 |
| FR | 323693 | 3/1903 |
| FR | 2 685 879 | 7/1993 |

* cited by examiner

*Primary Examiner* — Joseph C Rodriguez
(74) *Attorney, Agent, or Firm* — Hamre, Schumann, Mueller & Larson, P.C.

(57) ABSTRACT

An oscillating screen comprises a screening container inside which a screening means is disposed lying on a determinate screening plane (P), coinciding or inclined with respect to a horizontal oscillation plane (X), and oscillation means to move the screening container with respect to a fixed supporting structure. The oscillation means comprises a first movement unit provided with a first rotary shaft associated with a first eccentric element cooperating with the screening container, and a second movement unit having at least a second rotary shaft provided with a second eccentric element cooperating with the screening container. A transmission means connects the first rotary shaft and the second rotary shaft with each other, so that they have the same angular velocity.

9 Claims, 2 Drawing Sheets

OSCILLATING SCREEN

FIELD OF THE INVENTION

The present invention concerns an oscillating screen usable in separating solid materials, having a screening container, with a weight of some tonnes, inside which a screening means is disposed. The screening container is disposed slightly inclined with respect to a horizontal plane and is made to rotate and oscillate at high angular velocity.

BACKGROUND OF THE INVENTION

Oscillating screens are known, used in the separation of solid materials. Known oscillating screens are provided with a screening container of rectangular shape and with a weight of several tonnes, inside which a screening means is disposed, lying on a relative screening plane, inclined by a pre-set angle with respect to a horizontal oscillation plane. The screening container rests on a fixed supporting structure having supporting legs positioned at the corners of the screening container. Each supporting leg has shock-absorber elements made of elastomer material.

The screening container is moved in oscillating manner with respect to the fixed supporting structure by means of a rotary shaft, at an angular velocity comprised between about 100 revs and 300 revs per minute, bearing at a terminal part an eccentric element, with which the lower part of the screening container cooperates. This cooperation between the eccentric element and the screening container occurs by means of suitable mechanical coupling elements.

The rotary shaft is part of a structure having an adjustable counterweight element, acting as a balancing mass, and is moved by means of suitable drive means.

Typically, the eccentric element is disposed in correspondence with the central zone of the lower part of the screening container.

The oscillating movement of the body occurs, in optimum conditions, on a horizontal screening plane, so that the walls of the body remain, during this oscillating motion, in a condition of parallelism with respect to a vertical plane.

One disadvantage of such oscillating screens is that the high loads deriving from stresses of both static and dynamic type due to the oscillation of the container, which has a very great mass, at very high angular velocities, prevent said optimum oscillating conditions from being maintained; that is, they cause unwanted oscillations, that is, outside the horizontal oscillation plane, and also unequal load conditions that vary rapidly over time over the different support elements, reducing the working life thereof.

Said unwanted oscillations may occur on two different and perpendicular vertical planes: one is longitudinal (pitching), and the other is transverse (rolling). These unwanted oscillations cause irreparable damage to the structure of the screening container.

Another disadvantage is that, due to said stresses, a progressive deterioration is determined of the shock absorber elements made of elastomer material disposed on the supporting legs of the screening container. This makes the maintenance of said shock absorber elements particularly expensive, both due to the high cost of the elastomer material used, and also due to the frequent interventions of maintenance and replacement.

A known oscillating screen is described in DE-C-214.999, and is provided with two screening containers lying on four eccentric pins connected to crank shafts and provided with ball supports, disposed in twos along the sides of the container. The eccentric pins both support the screening containers and also determine their oscillating movement.

Another oscillating screen is described in FR-A-323.693, where there is a screening container supported at each of the four corners by supports, in which a rotation shaft and an eccentric are integrated, connected to the relative corner of the container in order to cause it to oscillate. In this case too, the support and oscillation are determined substantially by the elements themselves and in the same position, at the four corners of the container.

The two solutions described above have the disadvantage that they cause excessive mechanical stress to the eccentric mechanisms and consequently they do not ensure a precise rotational and/or oscillating movement.

Another known solution is shown in FR-A-2.685.879, where there is an oscillating screen with a mobile screening container, moved in rotation by a single eccentric mechanism located at one end of the container. The eccentric mechanism is provided with a main central counterweight, mounted on the rotation transmission shaft, and with two counterweights at the sides of the central counterweight, which rotate in the opposite direction, which balance only the centrifugal forces but do not neutralize the tilting torques deriving from the application of said centrifugal forces. Opposite the eccentric mechanism there are suspensions made of stratified elastomers.

Finally, U.S. Pat. No. 3,444,999 shows a free-moving vibrating screen, not controlled by a mechanical eccentric, cushioned by an air chamber, like the tire of an automobile, on which the vibrating body is disposed.

Purpose of the present invention is to achieve an oscillating screen that allows effectively to maintain optimum oscillation conditions and the precise synchronism of the rotational and/or oscillating movement and which, therefore, is not subject to rapid deterioration and/or irreparable damage to its most stressed components, particularly the coupling system between the eccentric element and the screening container and the suspension means associated with the supporting legs and the screening container itself.

The Applicant has devised, tested and embodied the present invention to overcome the shortcomings of the state of the art and to obtain these and other purposes and advantages.

SUMMARY OF THE INVENTION

The present invention is set forth and characterized in the independent claim, while the dependent claims describe other characteristics of the invention or variants to the main inventive idea.

In accordance with the above purpose, an oscillating screen comprises a screening container inside which a screening means is disposed, lying on a determinate screening plane, coinciding with, or inclined with respect to, a horizontal oscillation plane, and also comprises oscillation means able to move the screening container with respect to a fixed supporting structure, so that the screening container effects an oscillating motion on a controlled circular trajectory lying on said horizontal oscillation plane. Said oscillation means comprises a first movement unit provided with a first rotary shaft associated with a first eccentric element cooperating with the screening container.

According to a characteristic feature of the present invention, the fixed supporting structure is provided on the periphery with supporting legs, distinct from the oscillation means, able to support the screening container and having relative suspension and shock-absorber means, of the hydraulic or oil-dynamic type, disposed between the supporting legs and the screening container.

Said oscillation means also comprises a second movement unit, having at least a second rotary shaft provided with a second eccentric element cooperating with the screening container, and aligned with the first eccentric element along a longitudinal axis disposed substantially coincident with the center line of the lower surface of the screening container.

A transmission means is able to connect the first rotary shaft and the second rotary shaft with each other, so that they have the same angular velocity.

With the present invention, the eccentric elements transmit only the suitable rotational/oscillating movement and maintain the synchronism of said movement, which occurs without mechanical shocks and with no risk of thermal dilations, since all the mechanical stresses and thermal dilations affect the supporting legs of the fixed supporting structure.

Advantageously, the value of eccentricity of said first eccentric element with respect to said first rotary shaft is equal to the value of eccentricity of said second eccentric element with respect to said second rotary shaft.

In this way, only a rotational movement is imparted to the screening container, so that its lateral walls remain always parallel to a longitudinal axis passing through the axes of rotation of said two rotary shafts.

Moreover, advantageously, the value of each of the two eccentricities can be varied, so that the amplitude of said circular trajectory can be determined as chosen.

According to a variant, the values of the two eccentricities can be different from each other, in order to impart to the screening container a movement of lateral oscillation, as well as a rotational movement.

The oscillating screen made according to the present invention, thanks to the use of the two eccentric elements and their particular disposition aligned along the center line of the screening container, allows to maintain optimum oscillation conditions, with the screening container lying on a horizontal plane, preventing unwanted vertical oscillations, both longitudinal (pitching) and transverse (rolling), and also oscillations that displace the screening container from the parallel condition of its walls.

Thanks to the distinction between the supporting legs which support the screening container, and the eccentric elements which move the container, the oscillating screen thus made is moreover not subject to rapid deterioration and/or irreparable damage to its most stressed components, particularly the coupling system between the eccentric elements and the screening container.

The present invention does not need to adopt shock absorber elements made of elastomer material and allows to use the suspension and shock-absorber means of the hydraulic or oil-dynamic type, disposed between the relative supporting legs of the fixed supporting structure and the screening container, which is simplified and less expensive than the state of the art and which, furthermore, is not subject to deterioration or irreparable damage. As a result of the precise synchrony given by the eccentrics and the support and shock-absorption given by the supporting legs and the relative suspension and shock-absorber means, the screening container "floats" following its rotational and/or oscillating motion, with no disturbance of any kind in its trajectory.

According to a preferred solution, the suspension and shock-absorber means comprises a container element, for example a cup, mounted on a relative supporting leg, and a supporting and sliding element, such as a block, solid with the screening container and able to slide, following the rotational and/or oscillating movement of the screening container, on a sliding surface of the container element. Each supporting and sliding element is provided at the lower part with an insert, made of a material with a low friction coefficient, such as Teflon®, and able to slide on the sliding surface.

Furthermore, each supporting and sliding element has on its lower part a seating facing the sliding surface and inside which a fluid, water and/or oil, is able to be introduced, under pressure, so as to generate a supporting force and a hydraulic or oil-dynamic shock-absorption of the screening container.

Each container element is provided with an introduction pipe able to send the pressurized fluid to the sliding surface, in correspondence with the supporting and sliding element, and with a relative pipe to discharge the fluid.

According to another feature of the present invention, in axis with the first eccentric element of the first movement unit, two counterweight elements are mounted, respectively one underneath and one above the screening container, which, functioning as balancing masses, neutralize the centrifugal forces and tilting torques deriving from the application of said forces, and stabilize the oscillating motion of the screening container itself.

BRIEF DESCRIPTION OF THE DRAWINGS

These and other characteristics of the present invention will become apparent from the following description of a preferential form of embodiment, given as a non-restrictive example with reference to the attached drawings wherein.

DETAILED DESCRIPTION OF A PREFERENTIAL FORM OF EMBODIMENT

Figures 1, 1A, 1B:
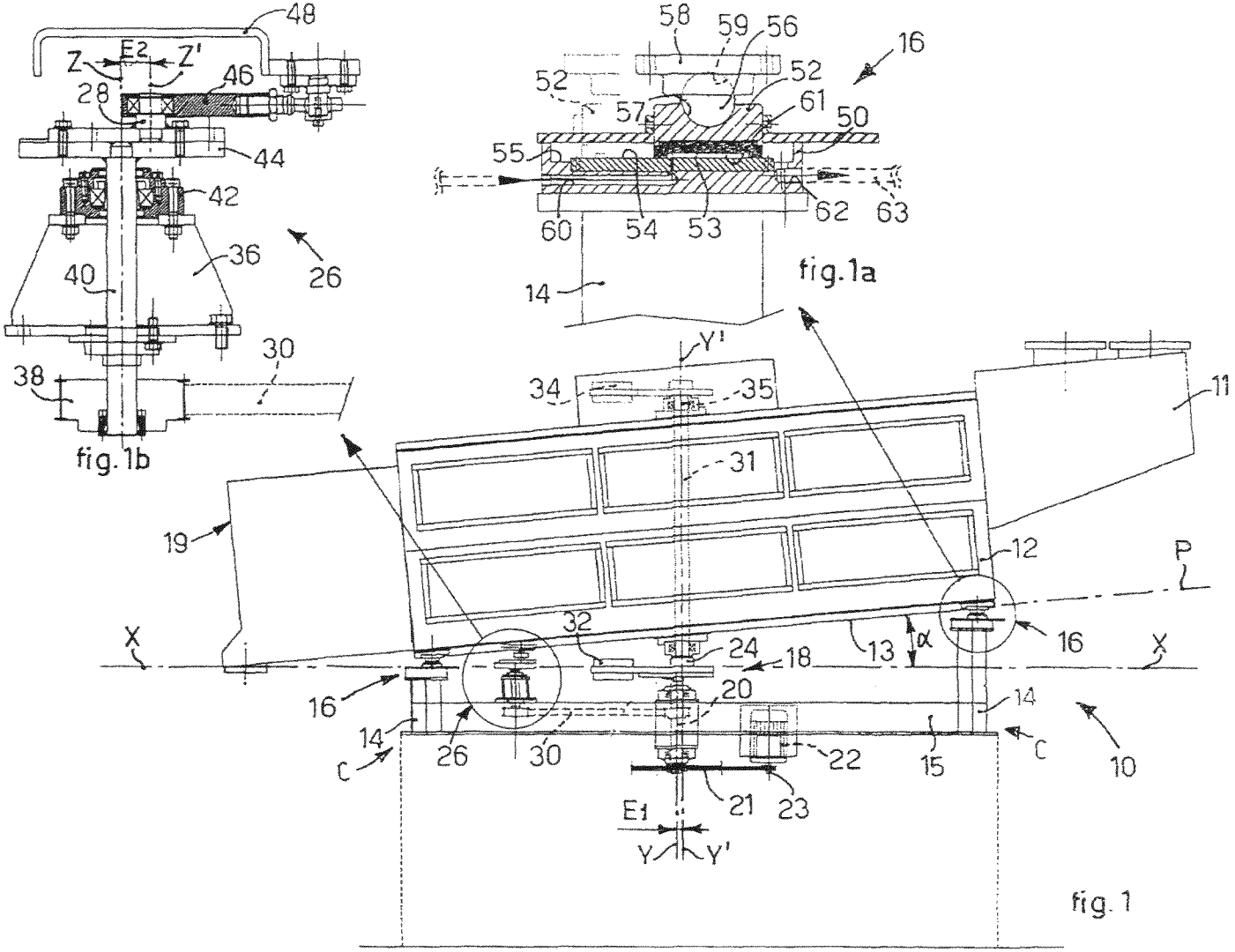
FIG. 1 is a lateral view of an oscillating screen according to the present invention.
FIG. 1*a* is a first enlarged detail of FIG. 1.
FIG. 1*b* is a second enlarged detail of FIG. 1.

With reference to FIG. 1, an oscillating screen 10 comprises a screening container 12 on which a feed unit 11 to feed the material to be screened is mounted, and a unit 19 to discharge the material screened.

All in all, the screen 10 has a weight that can vary from 2 tonnes to 20 tonnes, for example it can weigh 4.6 tonnes.

The container 12 has a lower surface 13 and corresponding upper surface, substantially rectangular, and four vertical walls.

For example the size of the container 12, without the feed unit 11 and discharge unit 19, is 4,100 millimeters in length, 1,500 millimeters in height and 2,700 millimeters in width.

The container 12 rests on six supporting legs 14 of a supporting frame 15, of which four legs 14 are disposed at the relative corners C of the supporting frame 15 and two intermediate legs. It is clear that the number of legs 14 may be lower, to a minimum of three, or higher, according to necessity. For example, there may be four legs 14 at the four corners C of the supporting frame 15. Or there may be two legs 14 at two corners C on the same side and a third leg 14 at the center of the opposite side.

Each supporting leg 14 is provided with relative fluid-dynamic suspensions 16, which will be illustrated in detail hereafter in this description.

Inside the container 12 screening devices are disposed, of a known type and not shown in the drawings, which lie on a relative screening plane P, which is inclined with respect to a horizontal oscillation plane X (FIG. 1) by a pre-determined angle α, for example equal to about 6 degrees. For the purposes of the present invention, the inclination of the screening plane P with respect to the horizontal oscillation plane X may not even be present, so that the screening plane P coincides with the horizontal oscillation plane X.

The oscillating screen 10 comprises a first movement unit 18, disposed in a central position and directly associated with the lower surface 13 of the container 12. The movement unit 18 is able to determine an oscillating motion, on a circular trajectory, lying on the horizontal oscillation plane X of the container 12 (FIG. 1).

In particular, the movement unit 18 comprises a rotary shaft 20, selectively made to rotate around a vertical axis Y by a relative motor 22. In this case, the rotary shaft 23 of the motor 22 is kinematically connected by means of a transmission belt to the rotary shaft 20.

An eccentric element 24 is associated with the rotary shaft 20 and disposed on an axis Y', parallel to the vertical axis Y and distant from it by an eccentricity E1 of a determinate value, in this case comprised between 20 mm and 60 mm.

The eccentric element 24 cooperates with the lower surface 13 of the container 12, to determine said oscillating motion of the container 12 with respect to the horizontal plane X.

Figure 3:
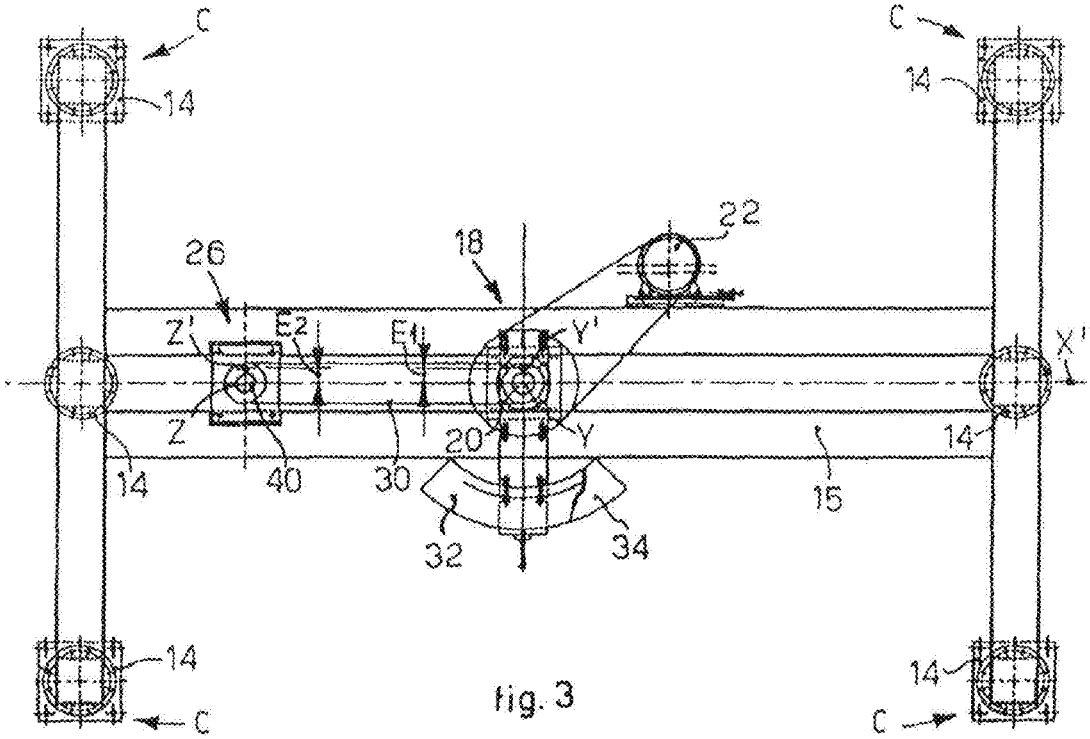
FIG. 3 is a plane view of the supporting frame and the two movement units of the oscillating screen in FIG. 1.

The screen 10 also comprises a second movement unit 26, disposed aligned with the first movement unit 18, along a longitudinal axis X' (FIG. 3), coinciding with the intersection of the horizontal plane X with the vertical plane passing through the center line of the oscillating screen 10.

The second movement unit 26 (FIG. 1*b*) comprises a shaft 40 rotating around its own vertical axis Z and having at a lower end a driven pulley 38. The driven pulley 38 is kinematically connected, by means of a transmission belt 30, to the rotary shaft 20 of the first movement unit 18. Therefore, the two rotary shafts 20 and 40 are able to rotate in synchronous phase and at the same angular velocity, comprised between about 150 revs per minute and 250 revs per minute and which, in this case, is 200 revs per minute.

The shaft 40 is supported by a frame with plates 36 and by relative flanges 42. The shaft 40, at an upper end, is also provided with a rotary plate 44, on which a second eccentric element 28 is mounted, disposed on an axis Z', parallel to the vertical axis Z and distant therefrom by an eccentricity E2 of a determinate value, also comprised in this case between 20 mm and 60 mm.

The second eccentric element 28 is connected to the element 48 of the upper surface 13 of the container 12 by means of the rod 46. In this way, the second eccentric element 28 is also able to impart a corresponding oscillating movement to the container 12, synchronized with the oscillating movement given by the first eccentric element 24, and with the same angular velocity.

In particular, the second eccentric element 28 is aligned with the first eccentric element 24 of the movement unit 18, along said longitudinal axis X' (FIG. 3), so as to determine an oscillating movement of the container 12 without any unwanted oscillations beyond those provided on the horizontal plane and in conditions of parallelism of the walls of the container 12.

The value of the eccentricity E1 of the first eccentric element 24 with respect to the rotary shaft 20 and the value of the eccentricity E2 of the second eccentric element 28 with respect to the rotary shaft 40 are variable individually as chosen, according to the oscillation trajectory that the screening container 12 is desired to make. In the form of embodiment described here, the value of the two eccentricities E1 and E2 is equal to 45 mm.

Figure 2:
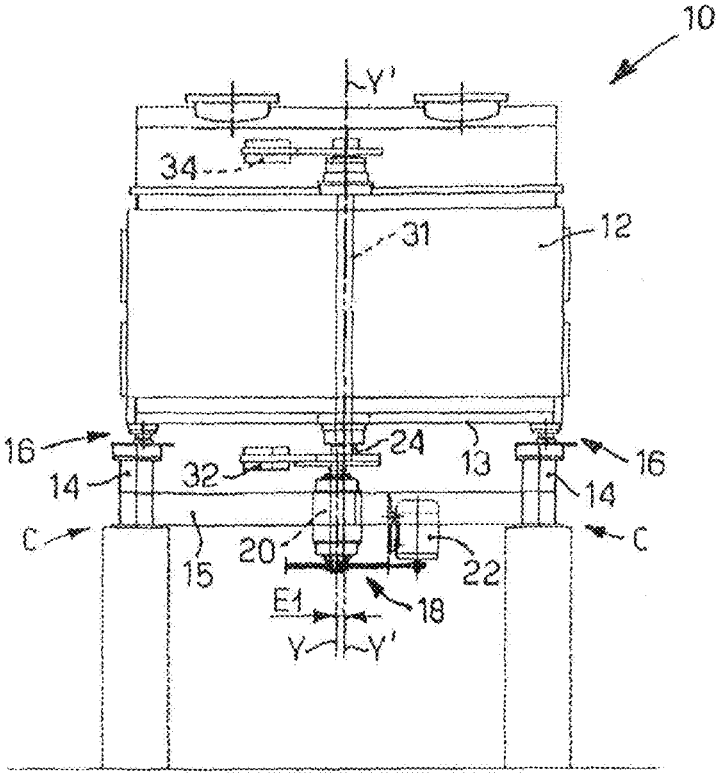
FIG. 2 is a front view of the oscillating screen in FIG. 1.

In order to further stabilize the oscillating movement of the container 12, a first counterweight 32 (FIGS. 1 and 2) is mounted on the first eccentric element 24, and a second counterweight 34 is mounted at the upper end 35 of a vertical shaft 31, disposed through inside the container 12, and coaxial with the vertical axis Y', and therefore also with the first eccentric element 24.

The two counterweights 32 and 34 are mounted in the same angular position and on the side diametrically opposite that of the two eccentricities E1 and E2 (FIG. 3), so that, by rotating in synchrony, they function as balancing masses.

In particular, the upper end 35 of the shaft 31 protrudes by a pre-determinate length beyond the container 12, so that the second counterweight 34 also protrudes beyond the container 12.

Therefore, the container 12 is set in oscillating movement on the horizontal plane between the two counterweights 32 and 34, considerably increasing the stabilizing effect.

The stabilizing effect determined by using two aligned eccentric elements 24 and 28 and, advantageously, the two counterweights 32 and 34, allows to achieve said fluid-dynamic suspensions 16, preferably hydraulic or oil-dynamic, in a simplified manner.

In particular, each of the fluid-dynamic suspensions 16 comprises a container element or cup 50, of a cylindrical type, mounted at the upper part on a relative supporting leg 14 (FIG. 1*a*). On the bottom of each cup 50 a sliding surface 54 is made, disposed horizontally, with a surface finish such as to render it very smooth. A supporting element or block 52, which is connected with the container 12, rests slidingly on the surface 54.

The block 52 for example has a diameter of about 120 millimeters and is provided at the lower part with an insert 53 made of a material with a low friction coefficient and/or self-lubricating, such as for example a polymer material like Teflon®, to allow a substantially low-friction sliding on the surface 54.

Moreover, the block 52 is provided at the upper part with a ball element 56 (FIG. 1*a*), which is inserted slidingly with a lower portion into a mating semi-spherical hollow 57 made at the upper part in the block 52 and with an upper portion in another semi-spherical hollow 59 made on a connection element 58 with the container 12. The connection element 58 is solidly attached to the lower surface 13 of the container 12.

In this way, the block 52 slides on the surface 54, following the oscillating motion of the container 12, always staying confined in the sliding surface 54 inside the cup 50. This movement of the block 52 is shown in FIG. 1*a*, where two different positions of the block 52 are shown respectively with a dotted line and a continuous line.

The sliding geometric coupling of the ball element 56 with the block 52 and with the connection element 58 functions as an articulated point and makes the disposition of the container 12, inclined by said angle α, compatible with the resting of the block 52 on the horizontal surface 54.

Moreover, thanks to the ball element 56, it is possible to determine minimum adjustments of the inclination of the container 12, compensating for possible small disconnections of the supporting plane.

To diminish the friction acting on the block 52 and to generate a supporting force and an oil-dynamic shock-absorption, into the sliding surface 54 of the container 50 lubricating oil is introduced at a pressure comprised between about 1 bar and about 50 bar, by means of an introduction pipe 60, communicating with a continuously operating circuit 63, picking up the oil from an oil tank, not shown in the drawings.

In particular, the lubricating oil is introduced centrally onto the sliding surface 54, in correspondence with a seating 61 made in said insert 53.

The introduction of the pressurized oil into the seating 61 determines the oil-dynamic supporting force and the formation of a thin film of oil between the surface 54 and the insert 53, which acts as an oil-dynamic support for the block 52.

Thanks to the oscillating movement of the block 52, the oil is distributed from the seating 61 over the whole surface 54 and is recovered in a relative annular collection channel 55 from which it is discharged, at environmental pressure, by means of a relative discharge pipe 62, also part of the circuit 63.

An advantageous form of embodiment of the oscillating screen 10 provides that it is made in modular form, for a large part using construction elements bolted together, so that it can be transported easily and assembled quickly.

It is clear that modifications and/or additions of parts may be made to the oscillating screen 10 as described heretofore, without departing from the field and scope of the present invention.

For example, motion may be supplied to the two movement units 18 and 26 by a single electric motor, associated with the shaft 40, instead of the shaft 20, or by two independent electric motors, one associated with the shaft 20 and another with the shaft 40, and controlled synchronously.

It is also clear that, although the present invention has been described with reference to specific examples, a person of skill in the art shall certainly be able to achieve many other equivalent forms of oscillating screen, having the characteristics as set forth in the claims and hence all coming within the field of protection defined thereby.

The invention claimed is:

1. An oscillating screen comprising a screening container inside which a screening means is disposed lying on a determinate screening plane (P), coinciding or inclined with respect to a horizontal oscillation plane (X), and oscillation means able to move said screening container with respect to a fixed supporting structure, so that said screening container effects a rotational motion on a controlled circular trajectory lying on said horizontal oscillation plane (X), wherein said oscillation means comprises a first movement unit provided with a first rotary shaft associated with a first eccentric element cooperating with said screening container, wherein said fixed supporting structure is provided on the periphery with supporting legs, distinct from the oscillation means, able to support the screening container and having relative suspension and shock-absorber means, of the hydraulic or oil-dynamic type, disposed between said supporting legs and said screening container, wherein said oscillation means also comprises a second movement unit, having at least a second rotary shaft provided with a second eccentric element cooperating with said screening container, and aligned with the first eccentric element along a longitudinal axis (X') disposed substantially coincident with the center line of said lower surface of said screening container, and wherein a transmission means connects said first rotary shaft and said second rotary shaft with each other, so that they have the same angular velocity.

2. The oscillating screen as in claim 1, wherein the value of eccentricity (E1) of said first eccentric element with respect to said first rotary shaft and the value of eccentricity (E2) of said second eccentric element with respect to said second rotary shaft can be equal to or different from each other.

3. The oscillating screen as in claim 1, wherein the supporting legs are disposed at the relative four corners (C) of the fixed supporting structure.

4. The oscillating screen as in claim 1, comprising a first counterweight element mounted solid with said first eccentric element disposed below said screening container and a second counterweight element mounted solid with an upper portion of a rotary shaft, solid and coaxial with said first eccentric element, and disposed above said screening container.

5. The oscillating screen as in claim 1, wherein said suspension and shock-absorber means comprises a container element mounted on a relative supporting leg and a supporting and sliding element, solid with said screening container and able to slide, following the rotational and oscillating movement of said screening container, on a sliding surface of said container element.

6. The oscillating screen as in claim 5, wherein each supporting and sliding element is provided at the lower part with an insert, made of material with a low friction coefficient and able to slide on said sliding surface.

7. The oscillating screen as in claim 6, wherein each supporting and sliding element of the suspension and shock-absorber means is provided at the lower part with a seating facing said sliding surface and inside which a pressurized fluid, water and/or oil, is able to be introduced in order to generate a supporting force and a hydraulic or oil-dynamic shock-absorption for said screening container.

8. The oscillating screen as in claim 7, wherein each container element of the suspension and shock-absorber means is provided with an introduction pipe able to send said pressurized fluid towards said sliding surface, in correspondence with said supporting and sliding element, and with a relative discharge pipe to discharge said fluid.

9. The oscillating screen as in claim 7, wherein said suspension and shock-absorber means comprises a ball element able to cooperate with an upper portion of said supporting and sliding element and with a lower portion of a relative connection element to said screening container, so as to adapt the disposition of the screening container to the support of the supporting and sliding element on the sliding surface.

* * * * *